US009892832B2

(12) United States Patent
Li et al.

(10) Patent No.: US 9,892,832 B2
(45) Date of Patent: Feb. 13, 2018

(54) LOW-COST DOUBLE-MAIN-PHASE CE PERMANENT MAGNET ALLOY AND ITS PREPARATION METHOD

(71) Applicant: Central Iron and Steel Research Institute, Beijing (CN)

(72) Inventors: Wei Li, Beijing (CN); Minggang Zhu, Beijing (CN); Haibo Feng, Beijing (CN); Anhua Li, Beijing (CN); Shulin Huang, Beijing (CN); Yanfeng Li, Beijing (CN); Yachao Sun, Beijing (CN); Jingdai Wang, Beijing (CN)

(73) Assignee: CENTRAL IRON AND STEEL RESEARCH INSTITUTE, Beijing (CN)

( * ) Notice: Subject to any disclaimer, the term of this patent is extended or adjusted under 35 U.S.C. 154(b) by 575 days.

(21) Appl. No.: 13/831,910

(22) Filed: Mar. 15, 2013

(65) Prior Publication Data

US 2014/0065004 A1 Mar. 6, 2014

(30) Foreign Application Priority Data

Aug. 30, 2012 (CN) ..... 2012 1 03115684

(51) Int. Cl.

| | |
|---|---|
| ***H01F 1/08*** | (2006.01) |
| ***H01F 41/02*** | (2006.01) |
| ***H01F 1/055*** | (2006.01) |

(52) U.S. Cl.
CPC ..... *H01F 1/086* (2013.01); *H01F 1/0553* (2013.01); *H01F 1/0557* (2013.01); *H01F 41/0266* (2013.01)

(58) Field of Classification Search
CPC ..... H01F 1/04; H01F 1/086; H01F 41/0266; C22C 38/16
USPC ..... 335/302
See application file for complete search history.

(56) References Cited

FOREIGN PATENT DOCUMENTS

JP 60218457 A * 11/1985

* cited by examiner

*Primary Examiner* — Weiping Zhu
(74) *Attorney, Agent, or Firm* — Perkins Coie LLP

(57) ABSTRACT

The invention discloses a low-cost double-main-phase Ce permanent magnet alloy and its preparation method, and belongs to technical field of rare earth permanent magnet material. The Ce permanent magnet alloy has a chemical formula of $(Ce_x,Re_{1-x})_aFe_{100-a-b-c}B_bTM_c$ in mass percent, wherein $0.4 \le x \le 0.8$, $29 \le a \le 33$, $0.8 \le b \le 1.5$, $0.5 \le c \le 2$, Re is one or more selected from Nd, Pr, Dy, Tb and Ho elements, and TM is one or more selected from Ga, Co, Cu, Nb and Al elements; the Ce permanent magnet alloy has a double-main-phase structure with a low $H_A$ phase in (Ce,Re)—Fe—B and a high $H_A$ phase in Nd—Fe—B. The double-main-phase Ce permanent magnet alloy of the present invention prepared by using a double-main-phase alloy method greatly lowers the production cost of magnet while maintaining excellent magnetic performances.

8 Claims, 1 Drawing Sheet

LOW-COST DOUBLE-MAIN-PHASE CE PERMANENT MAGNET ALLOY AND ITS PREPARATION METHOD

CROSS REFERENCE TO RELATED APPLICATION

The present application claims priority to and incorporates by reference Chinese patent application no. 2012103115684.5 filed Aug. 30, 2012.

TECHNICAL FIELD

The present invention relates to the technical field of rare earth permanent magnet materials, particularly a low-cost double-main-phase Ce permanent magnet alloy and its preparation method.

BACKGROUND OF THE INVENTION

As the third generation of rare earth permanent magnet materials, neodymium-iron-boron (Nd—Fe—B) features high residual magnetism $B_r$, high coercive force $H_{cj}$ and high magnetic energy product $(BH)_m$. So, it makes market immediately once such features are discovered, and becomes one of the key materials for modern science and technology development, and metal Nd in Nd—Fe—B magnet takes 90% or above of the cost of the raw materials. With the constant increase of the yield of rare earth permanent magnet all over the world, the utilization amount of metal Nd increases greatly, imposing great pressure on magnetic material manufacturers and users. Therefore, there is an urgent need to develop a novel permanent magnet alloy. Beside Nd, metal Ce among the natural rare earth resources features rich reserve and low cost. But, the magnetic torque Js and anisotropic field $H_A$ of $Ce_2Fe_{14}B$ falls far below those of $Nd_2Fe_{14}B$, and the basic magnetic parameters of a $Ce_2Fe_{14}B$ phase are calculated in the article [IEEE Trans. On Magn; 1984 MAG-20(5): 1584]. It is impossible to meet the requirements of user's on performance when $Ce_2Fe_{14}B$ magnet is prepared by using a traditional preparation method. At present, most of the patents regarding Ce-containing magnet is featured by the fact that Nd in $Nd_2Fe_{14}B$ is partly substituted by Ce and the content of Ce is typically not more than 40%, for example: in the patent CN1035737A of Central Steel & Iron Research Institute under Ministry of Metallurgical Industry, the content of Ce is not more than 30%; although Ce is added in the documents [J. Magn. Magn. Mater. 294, e127 (2005)] and [J. Appl. Phys. 105, 07A704 (2009)], the content of Ce is not more than 20%; the content of Ce is up to 40% in the patents CN102220538A and CN101694797 of Magnequench (Tianjin) Co., Ltd., furthermore, its preparation process used is different from that in the present invention, and the final product is isotropic magnetic powder instead of anisotropic magnet; the content of Ce rises to 40% in the article [J. Appl. Phys. 75, 6268 (1994)], but what this article focuses on is silicon (Si)-containing magnet, and a single alloy process is used, which is different from the present invention in aspects of composition and process. The majority of above patents and periodical documents lie in the adoption of a preparation method for directly smelting Ce into alloy, so that Nd in a main phase is substituted by Ce excessively to deteriorate the performance of magnet severely, and the residual magnetism, coercive force and magnetic energy product of a final product are all low.

In the prior art, preparation processes of a Ce permanent magnet alloy typically adopt a single alloy method and a double alloy method (also referred to as 'a liquid phase-added sintering method'). In these methods, the single alloy method is as follows: a fixed amount of metal Ce is added at the stage of alloy material mixing, Ce, Nd, Fe, B and other doping elements are mixed and smelted to obtain an alloy ingot with a single component, and then a traditional powder metallurgical sintering process is employed for preparing magnet. The double alloy method is as follows: a main phase alloy and an auxiliary phase alloy (or referred to as liquid phase alloy, i.e. rare earth rich alloy, or referred to as grain boundary phase) are smelted, wherein the auxiliary phase alloy plays a main role in regulating main phase composition segregation, repairing grain boundary or implementing liquid phase sintering (ZHOU Shouzeng et al., Nd—Fe—B-sintering rare earth permanent magnet material and technology, Metallurgical Industry Press, Edition of September 2011, Chapter 12). In addition, sintering at 1050° C. to 1080° C. is conducted by a conventional technology in both two traditional preparation processes above, in this way, excellent magnet performances are not achieved and the preparation cost of magnet is increased.

DISCLOSURE OF THE INVENTION

Aiming at the problems above, an object of the present invention is to provide a low-cost double-main-phase Ce permanent magnet alloy, in which the content of Nd is less than 50% of the total weight of rare earth and heavy rare earth element is used less or not used.

Another object of the present invention is to provide a preparation method of the low-cost double-main-phase Ce permanent magnet alloy with a performance that can meet the requirements of the intermediate- or above intermediate-level products in the current market. The preparation cost of magnet is dramatically lowered while excellent magnetic performances are maintained.

To achieve the objects above, the present invention provides the following technical solutions:

A low-cost double-main-phase Ce permanent magnet alloy is disclosed, wherein the chemical formula of the Ce permanent magnet alloy in mass percent is as follows: $(Ce_x,Re_{1-x})_aFe_{100-a-b-c}B_bTM_c$, wherein $0.4 \le x \le 0.8$, $29 \le a \le 33$, $0.8 \le b \le 1.5$, $0.5 \le c \le 2$, Re is one or more selected from Nd, Pr, Dy, Tb and Ho elements, and TM is one or more selected from Ga, Co, Cu, Nb and Al elements; the said Ce permanent magnet alloy has a double-main-phase structure with a low $H_A$ phase in (Ce,Re)—Fe—B and a high $H_A$ phase in Nd—Fe—B.

Said Re is Nd, Pr, Dy, and said TM is Ga, Co, Cu, Nb.

In said Ce permanent magnet alloy, the content of Ce accounts for 40% to 80% of the total weight of rare earth, and the content of Nd is less than 50% of the total weight of the rare earth.

Double main phases of the alloy are a $(Ce,Re)_2Fe_{14}B$ structure and a $Nd_2Fe_{14}B$ structure.

A preparation method of the double-main-phase Ce permanent magnet alloy is further disclosed, wherein the preparation method comprises the following steps:

(1) prepare two different main phase alloys using a double-main-phase alloy method, the first main phase alloy has the composition of $Nd_aFe_{100-a-b-c}B_bTM_c$ in mass percent, wherein $27 \le a \le 33$, $0.8 \le b \le 1.5$, $0.5 \le c \le 2$ and TM is one or more selected from Ga, Co, Cu, Nb and Al elements; the second main phase alloy has the composition of $(Ce_x,Re_{1-x})_aFe_{100-a-b-c}B_bTM_c$ in mass percent, wherein $0.4 \le x \le 0.9$, $29 \le a \le 33$, $0.8 \le b \le 1.5$, $0.5 \le c \le 2$, Re is one or more selected from Nd, Pr, Dy, Tb and Ho elements, and TM is one or more selected from Ga, Co, Cu, Nb and Al elements; and two raw materials are prepared respectively;

(2) smelt the two raw materials prepared in step (1) respectively to obtain the rapid solidified strips with a uniform thickness of 0.1 to 0.5 mm;

(3) conduct hydrogen crash for the two rapid solidified strips obtained from step (2) respectively and get the coarse crashed magnetic powders after dehydrogenization; afterwards, conduct jet milling on the coarse crashed magnetic powders respectively under a protective atmosphere of inert gas to obtain two magnetic powders with approximate particle sizes which is in the range of 1~6 μm;

(4) according to requirements of composition of different grades of permanent magnet alloys, weigh the two magnetic powders prepared in step (3) respectively at different proportions and then mix them in a mixer;

(5) under the protective atmosphere of inert gases, conduct the aligned forming for the mixed magnetic powders in a magnetic field of 1.5 to 2.3 T, and then conduct cool isostatic compression processing to obtain green bodies;

(6) put the green bodies after oriented forming and cool isostatic compression into a sintering furnace with a high vacuum for sintering; during a sintering process, heat for 0.5 h to 10 h at 400° C. to 800° C. for dehydrogenization at first, and then heat at a sintering temperature of 980° C. to 1050° C. for 1 h to 4 h; finally conduct water cooling or air cooling;

(7) conduct secondary tempering process on the resultants for 1 h to 4 h at 750° C. to 900° C. and at 450° C. to 550° C., respectively.

In said step (1), rare earth required for raw material preparation can use the mixed rare earth with a definite proportion of components.

In said step (2), first of all, the raw materials are put into the crucible pot of an intermediate-frequency induction smelting rapid solidified furnace, switch on the power to preheat the raw materials when the vacuum reaches $10^{-2}$ Pa or above, stop vacuum-pumping when the vacuum reaches $10^{-2}$ Pa or above again, inject highly pure Ar to enable Ar pressure inside the furnace reach −0.04 MPa to −0.08 MPa, and then smelt the raw materials; conduct electromagnetic stirring for refining after the raw materials are molten completely, and then pour the molten steel onto water-cooled copper rollers with a linear speed of 2~4 m/s to obtain the rapid solidified strips with a uniform thickness of 0.1 to 0.5 mm.

In said step (3), the rotating speed of a pneumatic concentration wheel during the jet mill process should be controlled at 3000 r/min to 4000 r/min.

In said step (6), a graded sintering system is adopted during a sintering process: the temperature rises by 3° C. every minute in the first half process, then rises by 1° C. every 3 minutes within the last 45 minutes to approach a set temperature, and is maintained for 1~4 h after reaching the set temperature, afterwards, water cooling or air cooling is conducted.

The design principle of the present invention is as follows:

By adopting the double-main-phase alloy method of the present invention, a double-main-phase structure of $Nd_2Fe_{14}B$ (i.e. Nd—Fe—B) and $(Ce,Re)_2Fe_{14}B$ (i.e. (Ce, Re)—Fe—B), instead of a mixed structure of $(Ce,Nd,Re)_2Fe_{14}B$ (see FIG. 1), is finally formed in magnet, wherein the first main phase (Nd—Fe—B) is a high $H_A$ phase not containing Ce (relatively high magnetization reversal capability), and has the composition of $Nd_aFe_{100-a-b-c}B_bTM_c$(wt. %); and the second main phase ((Ce,Re)—Fe—B) is a low $H_A$ phase containing rich Ce (relatively low magnetization reversal capability), and has the composition of $(Ce_x,Re_{1-x})_aFe_{100-a-b-c}B_bTM_c$(wt. %).

The coercive force mechanism of an R—Fe—B-based magnet is a mechanism of a nucleation and growth of magnetization reversal domain. However, such the double-main-phase magnet comprising a high $H_A$ phase ($Nd_2Fe_{14}B$) and a low $H_A$ phase $(Ce,Re)_2Fe_{14}B$ greatly overcomes the shortcomings of low $H_A$ and poor coercive force in $Ce_2Fe_{14}B$ since magnetization reversal domain is difficult to expand in the high $H_A$ phase. In addition, the applicant has added some other rare earth elements to the main phase with rich Ce to improve its intrinsic properties, thus eventually acquiring the low-cost double-main-phase Ce permanent magnet alloy.

The applicant has used a single alloy process to prepare a magnet with the nominal composition of $(Ce_x,Nd_{1-x})_{30}Fe_{ba1}B_1$ and conducted a test on the residual magnetisms $B_r$, the coercive forces $H_{cj}$ and the magnetic energy products $(BH)_m$ of the Ce permanent magnet alloy with the above nominal composition when x is equal to 0.4, 0.6 and 0.8. The test results shown in Table 1 apparently indicates that the (Ce,Nd)—Fe—B sintering magnet prepared by the single alloy method has relatively low coercive force and low magnetic energy product. The applicant has performed many experiments and found that structural regulation can be realized by substituting Fe by appropriate transition-metal elements and doping some other rare earth elements Re, which improved the coercive force to a certain extent without significant reduction of residual magnetism. Thus, the nominal composition of the low-cost double-main-phase Ce permanent magnet alloy in the present invention was determined, i.e. $(Ce_x,Re_{1-x})_aFe_{100-a-b-c}B_bTM_c$ (wt. %), wherein $0.4 \le x \le 0.8$, $29 \le a \le 33$, $0.8 \le b \le 1.5$ and $0.5 \le c \le 2$; Re is one or more selected from Nd, Pr, Dy, Tb and Ho elements, and TM is one or more selected from Ga, Co, Cu, Nb and Al elements. Then, the applicant adopts two different methods, i.e. a single alloy method and a double-main-phase alloy method, to prepare Ce permanent magnet alloys with different contents of Ce, and also tests their magnetic performances, which are shown in Table 1 in details.

It can be seen from Table 1 that, the single alloy method-prepared Ce permanent magnet alloy with the nominal composition of $(Ce_x,Re_{1-x})_aFe_{100-a-b-c}B_bTM_c$ (wt. %) as required by the present invention has magnetic performances superior to those of the single alloy method-prepared Ce permanent magnet alloy with the nominal composition of $(Ce_x,Nd_{1-x})_{30}Fe_{ba1}B_1$ (wt. %) of the prior art. Furthermore, the double-main-phase alloy method-prepared Ce permanent magnet alloy with the nominal composition of $(Ce_x,Re_{1-x})_1Fe_{100-a-b-c}B_bTM_c$ (wt. %) has the best magnetic performances. According to researches, the applicant believes that a double-main-phase structure of $Nd_2Fe_{14}B$ and $(Ce,Re)_2Fe_{14}B$, instead of a mixed structure of (Ce, Re)—Fe—B (see FIG. 1), is finally formed in magnet, which is the main reason for excellent magnetic performances.

TABLE 1

Performances of the Ce Permanent Magnet Alloys with different compositions and methods

| Nominal Composition (wt. %) | Preparation Method | x | Residual Magnetism $B_r$/kGs | Coercive Force $H_{cj}$/kOe | Magnetic Energy Product $(BH)_m$/MGOe |
|---|---|---|---|---|---|
| $(Ce_x,Nd_{1-x})_{30}Fe_{bal}B_1$ | Single Alloy Method | 0.4 | 11.2 | 7.5 | 29.0 |
| | | 0.6 | 10.8 | 6.2 | 23.0 |
| | | 0.8 | 10.2 | 5.5 | 18.3 |
| $(Ce_x,Re_{1-x})_aFe_{100-a-b-c}B_bTM_c$ | Single Alloy Method | 0.4 | 12.3 | 11.4 | 38 |
| | | 0.6 | 12.1 | 11 | 33 |
| | | 0.8 | 10.8 | 9.8 | 28 |
| | Double-Main-Phase Alloy Method | 0.4 | 13.2 | 14.2 | 42.5 |
| | | 0.5 | 12.7 | 13.6 | 40.2 |
| | | 0.6 | 12.6 | 13.5 | 37.6 |
| | | 0.7 | 11.4 | 12.2 | 32.1 |
| | | 0.8 | 11.7 | 12.6 | 30 |

Compared with the prior art, the present invention has the advantages listed below:

(1) the low-cost double-main-phase Ce permanent magnet alloy prepared by double-main-phase alloy method has a performance that can meet the requirements of the intermediate- or above intermediate-level products in the current market. The preparation cost of magnet is dramatically lowered while the excellent magnetic performances are maintained, thus, the cost performance of magnet is greatly raised, in addition, the preparation process of this low-cost double-main-phase Ce permanent magnet alloy is applicable to engineering scale production;

(2) the mixed rare earth can be used in the present invention, which reduces the waste caused by separation and purification of rare earth and lowers the cost;

(3) in the present invention, only rapid solidified alloy strips with two compositions need to be smelted, achieving higher degree of freedom in composition regulation;

(4) production cycle can be shortened and energy consumption can be decreased by low-temperature sintering and low-temperature tempering;

(5) the low-cost double-main-phase Ce permanent magnet alloy of the present invention has excellent magnetic performances in contrast to other Ce permanent magnet alloys in the prior art, wherein the magnetic energy product $(BH)_m$ is more than 30 MGOe and the coercive force $H_{cj}$ is more than 11 kOe;

(6) the content of Nd in the present invention is less than 50% of the total weight of rare earth, and heavy rare earth element is used less or not used. Currently on the market, the price for metal Nd is 600 Yuan/kg, the price for metal Ce is 100 Yuan/kg (by Aug. 16, 2012), the content of Ce in the present invention is above 40% of the total weight of rare earth, so the cost of raw materials of the double-main-phase Ce permanent magnet alloy is significantly lower than that of Nd—Fe—B magnet.

DETAILED DESCRIPTION OF THE EMBODIMENT MODES

The embodiments of the present invention will be further described below in accordance with the drawings. However, it shall be noted that the embodiments below are merely for the purpose of description, and the scope of the present invention is not limited to the embodiments below.

Figure 1:
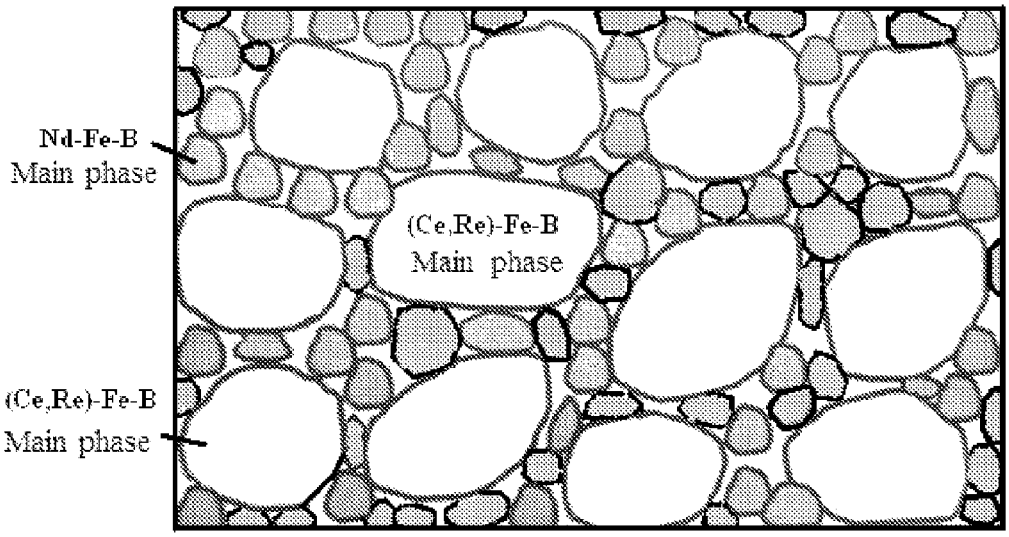
FIG. 1 is an illustrated diagram of the structure of the low-cost double-main-phase Ce permanent magnet alloy prepared in the present invention.
Figure 2:
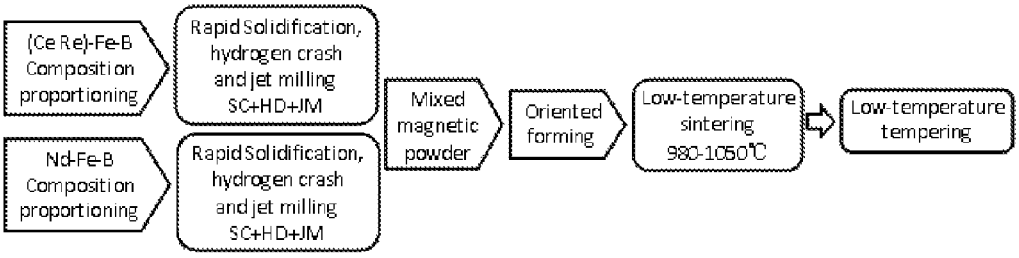
FIG. 2 is a schematic flowchart of the preparation process of the low-cost double-main-phase Ce permanent magnet alloy in the present invention.

FIG. 2 shows a schematic flowchart of the preparation process of the low-cost double-main-phase Ce permanent magnet alloy in the present invention. The preparation process comprises the following steps:

(1) prepare two different main phase alloys using a double-main-phase alloy method, the first main phase alloy has the composition of $Nd_aFe_{100-a-b-c}B_bTM_c$ in mass percent, wherein $27 \le a \le 33$, $0.8 \le b \le 1.5$, $0.5 \le c \le 2$ and TM is one or more selected from Ga, Co, Cu, Nb and Al elements; the second main phase alloy has the composition of $(Ce_x,Re_{1-x})_aFe_{100-a-b-c}B_bTM_c$ in mass percent, wherein $0.4 \le x \le 0.9$, $29 \le a \le 33$, $0.8 \le b \le 1.5$, $0.5 \le c \le 2$, Re is one or more selected from Nd, Pr, Dy, Tb and Ho elements, and TM is one or more selected from Ga, Co, Cu, Nb and Al elements; and two raw materials are prepared respectively;

(2) respectively smelt the two raw materials prepared in step (1) to obtain the rapid solidified strips with a uniform thickness of 0.1 to 0.5 mm;

(3) respectively conduct hydrogen crash for the two rapid solidified strips obtain from step (2) and get the coarse crashed magnetic powders after dehydrogenization; afterwards, conduct jet milling the coarse crashed magnetic powders respectively under a protective atmosphere of inert gas to obtain two magnetic powders with approximate particle sizes which is in the range of 1~6 μm;

(4) according to requirements of composition of different grades of permanent magnet alloys, weigh two kinds of magnetic powders prepared in step (3) respectively at different proportions and then mix them in a mixer;

(5) under the protective atmosphere of inert gases, conduct the oriented forming for the mixed magnetic powders in a magnetic field of 1.5 to 2.3 T, and then conduct cool isostatic compression processing to obtain green bodies;

(6) put the green bodies after oriented forming and isostatic compression into a sintering furnace with a high vacuum for sintering; during a sintering process, heat for 0.5 h to 10 h at 400° C. to 800° C. for dehydrogenization at first, and then conduct water cooling or air cooling after heat at 980° C. to 1050° C. for 1 h to 4 h;

(7) conduct secondary tempering process on the resultants for 1 h to 4 h at 750° C. to 900° C. and 450° C. to 550° C., respectively.

Embodiment 1

As shown in FIG. 2, the double-main-phase Ce permanent magnet alloy with the designed composition of $[(Ce,Pr)_{0.9}Nd_{0.1}]_{30}Fe_{bal}B_1TM_{0.67}$ (TM=Ga, Co, Cu, Nb) (wt. %) is prepared according to the preparation method of the present invention, wherein the content of Ce accounts for 80% of the total weight of rare earth. The preparation method specifically comprises the following steps:

(1) prepare two different main phase alloys, the first main phase alloy has the composition of $Nd_{30}Fe_{bal}B_1TM_{0.67}$ (TM=Ga, Co, Cu, Nb) in mass percent, and the second main phase alloy has the composition of $[Ce_{0.89}Pr_{0.11}]_{30}Fe_{bal}B_1TM_{0.67}$ (TM=Ga, Co, Cu, Nb) in mass percent; and raw materials are prepared respectively;

(2) smelt the raw materials prepared respectively as below: first of all, put the raw materials into the crucible pot of an intermediate-frequency induction smelting rapid solidified furnace, switch on power to preheat the raw materials when the vacuum reaches $10^{-2}$ Pa or above, stop vacuum-pumping when the vacuum reaches $10^{-2}$ Pa or above again, inject highly pure Ar to enable Ar pressure inside the furnace reach −0.06 MPa, and then smelt the raw materials; conduct electromagnetic stirring for refining after the raw materials are molten completely, and then pour the molten steel onto water-cooled copper rollers with a linear speed of 3 m/s to obtain the rapid solidified strips with a uniform thickness of 0.3 mm;

(3) put the two kinds of rapid solidified strips prepared in hydrogenization furnaces respectively for coarse crush and then for dehydrogenization afterwards, conduct jet milling on the coarse crashed magnetic powders respectively under a protective atmosphere of inert gas to obtain magnetic powders with average particle sizes ranging from 1.5 μm to 4.5 μm, wherein the rotating speed of a pneumatic concentration wheel during the jet mill process is maintained at 3100 r/min to ensure approximate particle sizes of the two magnetic powders;

(4) mix the two kinds of magnetic powders prepared in step 3 according to the designed composition, wherein the magnetic powder with the composition of $[Ce_{0.89}Pr_{0.11}]_{30}Fe_{bal}B_1TM_{0.67}$ (TM=Ga, Co, Cu, Nb) (wt. %) accounts for 90% of the total weight approximately, and the two magnetic powders are fully mixed in a mixer;

(5) under the protective atmosphere of inert gases, conduct the oriented forming for the mixed magnetic powders in a magnetic field of 2 T, and then conduct cool isostatic compression processing to obtain green bodies;

(6) put the green bodies after oriented forming into a sintering furnace with a high vacuum for sintering; during a sintering process, preserve heat at 400° C., 600° C. and 800° C. for 1 h respectively for further dehydrogenization, adopt a graded sintering system: the temperature rises by 3° C. every minute in the first half process, then rises by 1° C. every 3 minutes within the last 45 minutes to approach a set temperature, and is maintained for 2 h after reaching the set temperature, afterwards, water cooling or air cooling is conducted;

(7) finally, temper the resultants for 2 h at 900° C. and 520° C., respectively.

The magnetic performances of magnet, measured by an NIM-2000HF permanent magnet material standard measurement device, are as shown in Table 2.

TABLE 2

Magnetic Performances of Double-Main-Phase Ce Permanent Magnet Alloy in Embodiment 1

| Nominal Composition (wt. %) | $B_r$/kGs | $H_{cj}$/kOe | $(BH)_m$/MGOe |
|---|---|---|---|
| $[(Ce,Pr)_{0.85}Nd_{0.15}]_{30}Fe_{bal}B_1TM_{0.67}$ (Ga, Co, Cu, Nb) | 11.7 | 12.6 | 30.1 |

Embodiment 2

As shown in FIG. 2, the double-main-phase Ce permanent magnet alloy with the designed composition of $[(Ce,Pr)_{0.7}Dy_{0.05}Nd_{0.25}]_{30}Fe_{bal}B_1TM_{0.67}$ (TM=Ga, Co, Cu, Nb) (wt. %) is prepared according to the preparation method of the present invention, wherein the content of Ce accounts for 65% of the total weight of rare earth. The preparation method specifically comprises the following steps:

(1) prepare two different main phase alloys, the first main phase alloy has the composition of $Nd_{30}Fe_{bal}B_1TM_{0.67}$ (TM=Ga, Co, Cu, Nb) in mass percent, and the second main phase alloy has the composition of $[Ce_{0.75}(Pr,Dy)_{0.25}]_{30}Fe_{bal}B_1TM_{0.67}$ (TM=Ga, Co, Cu, Nb) in mass percent; and raw materials are prepared respectively;

(2) smelt the raw materials prepared respectively as below: first of all, put the raw materials into the crucible pot of an intermediate-frequency induction smelting rapid solidified furnace, switch on power to preheat the raw materials when the vacuum reaches $10^{-2}$ Pa or above, stop vacuum-pumping when the vacuum reaches $10^{-2}$ Pa or above again, inject highly pure Ar to enable Ar pressure inside the furnace reach −0.06 MPa, and smelt then the raw materials; conduct electromagnetic stirring for refining after the raw materials are molten completely, and then pour the molten steel onto water-cooled copper rollers with a linear speed of 3 m/s to obtain the rapid solidified strips with a uniform thickness of 0.3 mm;

(3) put the two rapid solidified strips prepared in hydrogenization furnaces respectively for coarse crush and then for dehydrogenization, afterwards, conduct jet milling on the coarse crashed magnetic powders respectively under a protective atmosphere of inert gas to obtain magnetic powders with an average particle size of 3 μm, wherein the rotating speed of a pneumatic concentration wheel during the jet mill process is maintained at 3100 r/min to ensure approximate particle sizes of the two magnetic powders;

(4) mix the two magnetic powders prepared in step 3 according to the designed composition, wherein the magnetic powder with the composition of $[Ce_{0.75}(Pr,Dy)_{0.25}]_{30}Fe_{bal}B_1TM_{0.67}$ (TM=Ga, Co, Cu, Nb) (wt. %) accounts for ⅗ of the total weight approximately, and the two magnetic powders are fully mixed in a mixer;

(5) under the protective atmosphere of inert gases, conduct the oriented forming for the mixed magnetic powders in a magnetic field of 2 T, and then conduct cool isostatic compression processing to obtain green bodies;

(6) put the green bodies after oriented forming into a sintering furnace with a high vacuum for sintering; during a sintering process, preserve heat at the temperature of 400° C., at 600° C. and at 800° C. for 1 h respectively for further dehydrogenization, adopt a graded sintering system: the temperature rises by 3° C. every minute in the first half process, then rises by 1° C. every 3 minutes within the last 45 minutes to approach a set temperature, and is maintained for 2 h after reaching the set temperature, afterwards, conduct water cooling or air cooling; and (7) finally, temper the resultants for 2 h at 900° C. and 520° C., respectively.

The magnetic performances of magnet, measured by an NIM-2000HF rear earth permanent magnet standard measurement device, are as shown in Table 3.

TABLE 3

Magnetic Performances of Double-Main-Phase Ce Permanent Magnet Alloy in Embodiment 2

| Nominal Composition (wt. %) | $B_r$/kGs | $H_{cj}$/kOe | $(BH)_m$/MGOe |
|---|---|---|---|
| $[(Ce,Pr)_{0.7}Dy_{0.05}Nd_{0.25}]_{30}Fe_{bal}B_1TM_{0.67}$ (TM = Ga, Co, Cu, Nb) | 12.3 | 12.39 | 34.2 |

Embodiment 3

As shown in FIG. 2, the double-main-phase Ce permanent magnet alloy with the designed composition of $[(Ce,Pr)_{0.5}Nd_{0.5}]_{30}Fe_{ba1}B_1TM_{0.67}$ (TM=Ga, Co, Cu,Nb) (wt. %) is prepared according to the preparation method of the present invention, wherein the content of Ce accounts for 40% of the total weight of rare earth. The preparation method specifically comprises the following steps:

(1) prepare two different main phase alloys, the first main phase alloy has the composition of $Nd_{30}Fe_{ba1}B_1TM_{0.67}$ (TM=Ga, Co, Cu, Nb) in mass percent, and the second main phase alloy has the composition of $(Ce_{0.8}Pr_{0.2})_{30}Fe_{ba1}B_1TM_{0.67}$ (TM=Ga, Co, Cu, Nb) in mass percent; and raw materials are prepared respectively;

(2) smelt the raw materials prepared respectively as below: first of all, put the raw materials into the crucible pot of an intermediate-frequency induction smelting rapid solidified furnace, switch on power to preheat the raw materials when the vacuum reaches $10^{-2}$ Pa or above, stop vacuum-pumping when the vacuum reaches $10^{-2}$ Pa or above again, inject highly pure Ar to enable Ar pressure inside the furnace reach −0.06 MPa, and then smelt the raw materials; conduct electromagnetic stirring for refining after the raw materials are molten completely, and then pout the molten steel onto water-cooled copper rollers with a linear speed of 3 m/s to obtain the rapid solidified strips with a uniform thickness of 0.3 mm;

(3) put the two rapid solidified strips prepared in hydrogenization furnaces respectively for coarse crush and then for dehydrogenization, afterwards, conduct jet milling on the coarse crashed magnetic powders respectively under a protective atmosphere of inert gas to obtain magnetic powders with an average particle size of 3 μm, wherein the rotating speed of a pneumatic concentration wheel during the jet mill process is maintained at 3100 r/min to ensure approximate particle sizes of the two magnetic powders;

(4) mix the two magnetic powders prepared in step 3 according to the designed composition, wherein the magnetic powder with the composition of $(Ce_{0.8}Pr_{0.2})_{30}Fe_{ba1}B_1TM_{0.67}$ (TM=Ga, Co, Cu, Nb) (wt. %) accounts for ½ of the total weight approximately, and the two magnetic powders are fully mixed in a mixer;

(5) under the protective atmosphere of inert gases, conduct the oriented forming for the mixed magnetic powders in a magnetic field of 2 T, and then conduct cool isostatic compression processing to obtain green bodies;

(6) put the green bodies after oriented forming into a sintering furnace with a high vacuum for sintering; during a sintering process, preserve heat at the temperature of 400° C., at 600° C. and at 800° C. for 1 h respectively for further dehydrogenization, adopt a graded sintering system: the temperature rises by 3° C. every minute in the first half process, then rises by 1° C. every 3 minutes within the last 45 minutes to approach a set temperature, and is maintained for 2 h after reaching the set temperature, afterwards, water cooling or air cooling is conducted; and (7) finally, temper the resultants for 2 h at 900° C. and 520° C., respectively.

The magnetic performances of magnet, measured by an NIM-2000HF rear earth permanent magnet standard measurement device, are as shown in Table 4.

TABLE 4

Magnetic Performances of Double-Main-Phase Ce Permanent Magnet Alloy in Embodiment 3

| Nominal Composition (wt. %) | $B_r$/kGs | $H_{cj}$/kOe | $(BH)_m$/MGOe |
|---|---|---|---|
| $[(Ce,Pr)_{0.5}Nd_{0.5}]_{30}Fe_{bal}B_{0.94}TM_{0.67}$ (TM = Ga, Co, Cu, Nb) | 12.7 | 13.6 | 40.2 |

It can be seen from the above embodiments 1-3 that, the double-main-phase Ce permanent magnet alloy of the present invention has the following magnetic performances: $B_r$=11.7 kGs to 12.7 kGs, $H_{cj}$=12.39 kOe to 13.6 kOe, and $(BH)_m$=30 MGOe to 40.2 MGOe, and has excellent magnetic performances in contrast to other Ce permanent magnet alloys in the prior art.

What is claimed is:

1. A low-cost double-main-phase Ce permanent magnet alloy, characterized in that its chemical formula in mass percent is $(Ce_x,Re_{1-x})_aFe_{100-a-b-c}B_bTM_c$, wherein, $0.4 \le x \le 0.8$, $29 \le a \le 33$, $0.8 \le b \le 1.5$, $0.5 \le c \le 2$, Re is one or more selected from Nd, Pr, Dy, Tb and Ho elements, and TM is one or more selected from Ga, Co, Cu, Nb and Al elements; the said Ce permanent magnet alloy has a 2:14:1 type double-main-phase structure as follows: with a low HA second magnetic phase in (Ce,Re)—Fe—B and a high HA first magnetic phase in Nd—Fe—B;

the double-main-phase Ce permanent magnet alloy was prepared by two different kinds of main phase alloys with a double-main-phase method;

the double-main-phase Ce permanent magnet alloy was prepared by following two different kinds of main phase alloys with a double-main-phase method: the first main phase alloy has the composition of $Nd_aFe_{100-a-b-c}B_bTM_c$ in mass percent, wherein $27 \le a \le 33$, $0.8 \le b \le 1.5$, $0.5 \le c \le 2$ and TM is one or more selected from Ga, Co, Cu, Nb and Al elements; the second main phase alloy has the composition of $(Ce_{x1},Re_{1-x1})_aFe_{100-a-b-c}B_bTM_c$ in mass percent, wherein $0.4 \le x1 \le 0.9$, $29 \le a \le 33$, $0.8 \le b \le 1.5$, $0.5 \le c \le 2$, Re is one or more selected from Nd, Pr, Dy, Tb and Ho elements, and TM is one or more selected from Ga, Co, Cu, Nb and Al elements; the said two raw materials are prepared respectively;

the double main phases of the alloy are $(Ce,Re')_2Fe_{14}B$ structure and $Nd_2Fe_{14}B$ structure.

2. The double-main-phase Ce permanent magnet alloy as claim 1, wherein said Re is Nd, Pr, Dy, and said TM is Ga, Co, Cu, Nb.

3. The double-main-phase Ce permanent magnet alloy as claim 1, wherein in said Ce permanent magnet alloy, the content of Ce accounts for 40% to 80% of the total weight of rare earth, and the content of Nd is less than 50% of the total weight of the rare earth.

4. A preparation method of the double-main-phase Ce permanent magnet alloy as claim 1, comprising (1) preparing two different main phase alloys using a double-main-phase alloy method, the first main phase alloy has the composition of $Nd_aFe_{100-a-b-c}B_bTM_c$ in mass percent, wherein $27 \leq a \leq 33$, $0.8 \leq b \leq 1.5$, $0.5 \leq c \leq 2$ and TM is one or more selected from Ga, Co, Cu, Nb and Al elements; the second main phase alloy has the composition of $(Ce_x,Re_{1-x})_aFe_{100-a-b-c}B_bTM_c$ in mass percent, wherein $0.4 \leq x \leq 0.9$, $29 \leq a \leq 33$, $0.8 \leq b \leq 1.5$, $0.5 \leq c \leq 2$, Re is one or more selected from Nd, Pr, Dy, Tb and Ho elements, and TM is one or more selected from Ga, Co, Cu, Nb and Al elements; the said two raw materials are prepared respectively;

(2) smelting the two raw materials prepared in step (1) respectively to obtain the rapid solidified strips with a uniform thickness of 0.1 to 0.5 mm;

(3) conducting hydrogen crash for the two kinds of rapid solidified strip obtained from step (2) respectively and get the coarse crashed magnetic powders after dehydrogenization; afterwards, conduct jet milling on the coarse crashed magnetic powders respectively under a protective atmosphere of inert gas to obtain two kinds of magnetic powders with approximate particle sizes which is in the range of 1~6 μm;

(4) according to requirements of composition of different grades of permanent magnet alloys, weighing two kinds of magnetic powder prepared in step (3) respectively at different proportions and then mix them in a mixer;

(5) under the protective atmosphere of inert gases, conducting oriented forming for the mixed magnetic powders in a magnetic field of 1.5 to 2.3 T, and then conduct cool isostatic compression processing to obtain green bodies;

(6) put the green bodies after oriented forming and cool isostatic compression into a sintering furnace with a high vacuum for sintering; during a sintering process, heating for 0.5 h to 10 h at 400° C. to 800° C. for dehydrogenization at first, and then heat at 980° C. and 1050° C. for 1 h to 4 h sequentially, finally conduct water cooling or air cooling;

(7) conducting secondary tempering process on the resultants for 1 h to 4 h at 750° C. to 900° C. and 450° C. to 550° C., respectively.

5. The preparation method as claim 4, wherein in the said step (1), rare earth required for raw material preparation can use the mixed rare earth with a definite proportion of components.

6. The preparation method as claim 4, wherein in the said step (2), first of all, the raw materials are put into the crucible pot of an intermediate-frequency induction smelting rapid solidified furnace, switch on the power to preheat the raw materials when the vacuum reaches 10-2 Pa or above, stop vacuum-pumping when the vacuum reaches 10-2 Pa or above again, inject highly pure Ar to enable Ar pressure inside the furnace reach −0.04 MPa to −0.08 MPa, and then smelt the raw materials; conduct electromagnetic stirring for refining after the raw materials are molten completely, and then pour the molten steel onto water-cooled copper rollers with a linear speed of 2~4 m/s to obtain the rapid solidified strips with an uniform thickness of 0.1 to 0.5 mm.

7. The preparation method as claim 4, wherein in the said step (3), the rotating speed of a pneumatic concentration wheel during the jet mill process should be controlled at 3000 r/min to 4000 r/min.

8. The preparation method as claim 4, wherein in said step (6), a graded sintering system is adopted during a sintering process: the temperature rises 3° C. every minute in the first half process, close to the set temperature of the last 45 minutes, the temperature rises 1° C. every three minutes, and is maintained for 1~4 h after reaching the set temperature, afterwards, water cooling or air cooling is conducted.

* * * * *